US005995777A

United States Patent [19]

Nagamochi et al.

[11] Patent Number: 5,995,777

[45] Date of Patent: Nov. 30, 1999

[54] IMAGE FORMING APPARATUS AND EXAMINATION IMAGE FORMING METHOD IN IMAGE FORMING APPARATUS

[75] Inventors: Katsuya Nagamochi, Tokyo, Japan; Rintaro Nakane, Kanagawa-ken, Japan

[73] Assignee: Kabushiki Kaisha Toshiba, Kawasaki, Japan

[21] Appl. No.: 09/205,230

[22] Filed: Dec. 4, 1998

[30] Foreign Application Priority Data

Dec. 18, 1997 [JP] Japan ..... 9-349364

[51] Int. Cl.[6] ..... G03G 15/00

[52] U.S. Cl. ..... 399/49; 399/72; 399/74

[58] Field of Search ..... 399/49, 46, 47, 399/48, 72, 74, 60

[56] References Cited

U.S. PATENT DOCUMENTS 5,351,107 9/1994 Nakane et al. ..... 399/49
5,386,276 1/1995 Swales et al. ..... 399/60 X
5,826,139 10/1998 Nacman et al. ..... 399/72

*Primary Examiner*—Arthur T. Grimley
*Assistant Examiner*—Hoan Tran
*Attorney, Agent, or Firm*—Foley & Lardner

[57] ABSTRACT

An image forming apparatus of the present invention includes an exposure portion to form an electrostatic latent image by exposing the surface of an image carrier, a developing device to form a developer image by developing the electrostatic latent image formed on the image carrier with a developer and a detecting device that has a specified detecting area on the image carrier and detects the quality change of an image formed on the detecting area. The image forming apparatus of the present invention further includes a means to decide a minimum examination image forming area that is nearly in accord with the detecting area of the detecting device by forming an examination image for the image change detection on the image carrier by the exposure portion and the developing device, detecting the formed examination image by the detecting means and changing the examination image forming area according to the detection result of the detecting device.

20 Claims, 14 Drawing Sheets

IMAGE FORMING APPARATUS AND EXAMINATION IMAGE FORMING METHOD IN IMAGE FORMING APPARATUS

BACKGROUND OF THE INVENTION

1. Field of the Invention

The present invention relates to an image forming apparatus such as a copying machine, printer, etc., which forms images according to the electrophotographic system and an examination image forming method in such image forming apparatus.

2. Description of the Related Art

Electro-photographic copying machines, printers, etc. are widely known as image forming apparatus. For instance, in case of electro-photographic copying machines, etc., after uniformly charged by a main charger, the surface of a photo-conductive drum is exposed and an electrostatic latent image corresponding to a desired image is formed on the surface of the photo-conductive drum. Then, this electrostatic latent image is developed by a developer supplied from a developing device and a developer image is formed and further, this formed developer image is transferred on a transfer paper by a transfer charger and an image is formed thereon.

On this type of copying machine, in order for the stabilized image forming, the quality of a formed image is examined periodically and if it is out of a specified proper range, charging amount, exposing amount, etc. are adjusted or replacement of a photo-conductive drum is urged so as to prevent the quality change.

A method to judge the image quality by measuring the density of an examination image by an image density sensor after forming this examination image in a specified pattern on the surface of a photo-conductive drum and comparing it with a specified value has been known as a method to examine the image quality.

The formation of such an examination image consumes a developer irrelevant of a developer that is used for the normal image formation by user and it is therefore desirable to form an examination image as could as small and minimize the consumption of developer.

On the other hand, in order to measure the density of an examination image accurately, it is needed that the image forming area of an examination image is in accord with the detecting area of a sensor. Normally, a size of an examination image is set larger than an actually required size by taking a solid difference of the main body of a copying machine and a solid difference of a sensor into consideration so that the examination image forming area certainly agrees with the detecting area of a sensor.

The solid difference of the main body of a copying machine referred to here denotes a fluctuation between a plurality of same model of copying machines manufactured at a plant, for instance, the different mounting position of a photo-conductive drum or mounting position of a sensor.

The solid difference of a sensor denotes a fluctuation in the width of detecting areas or a fluctuation in the sensitivity of sensors.

However, when detecting a change in image quality using an unnecessarily large sized examination image as described above, the consumption of developer will increase unnecessarily and becomes a problem from the economical viewpoint.

Further, for the purpose of reducing consumption of developer by reducing an examination image size, it is possible to manually adjust the examination image forming position and the sensor detecting position for each copying machine. In this case, however, much adjusting time is needed and the drop of manufacturing efficiency and increase in manufacturing cost will result.

SUMMARY OF THE INVENTION

The present invention has been made in view of the above viewpoint and it is an object to provide an image forming apparatus that is capable of certainly detecting change in image without increasing consumption of developer and an examination image forming method for an image forming apparatus.

The present invention provides an image forming apparatus comprising means for exposing a surface of an image carrier to form an electrostatic latent image on the image carrier, means for developing the electrostatic latent image to form a developer image on the image carrier, means having a specified detecting area on the image carrier for detecting a quality change of the developer image formed on the detecting area, and means for deciding a minimum examination image forming area which is nearly in accord with the detecting area of the detecting means by changing the examination image forming area according to the detecting result of the detecting means.

Further, the present invention provides an examination image forming method in an image forming apparatus comprising the steps of exposing an image carrier to form an electrostatic latent image, developing the electrostatic latent image with a developer to form a developer image on the image carrier, a first detecting step a quality change of an image formed in a detecting area on the image carrier, a second detecting step to form an examination image for an image quality change detecting on the image carrier by the exposing step and developing step and detects the examination image, changing the examination image forming area according to the detecting result of the second detecting step, and deciding a minimum examination image forming area that is nearly in accord with the detecting area of the second detecting step.

DETAILED DESCRIPTION OF THE PREFERRED EMBODIMENTS

Hereinafter, the embodiments of the present invention applied to an electro-photographic copying machine will be described in detail with reference to the attached drawings.

Figure 1:
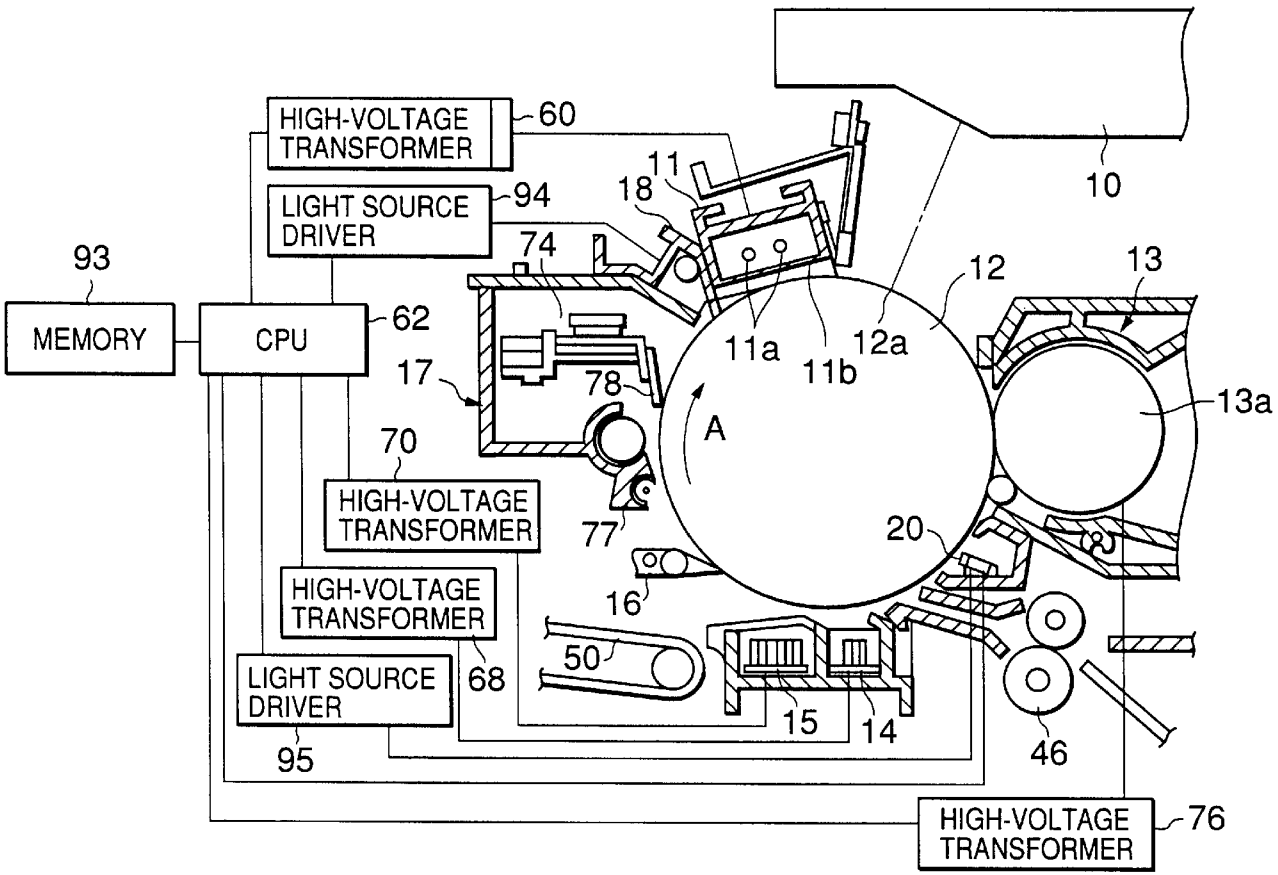
FIG. 1 is a schematic diagram showing an image forming portion of a digital copying machine showing a first embodiment of the present invention.

FIG. 1 shows an image forming portion of a digital copying machine as a first embodiment of the present invention. This image forming portion is equipped with a photo-conductive drum 12, which is made of, for instance, arsenic selenium, as an image carrier. The photo-conductive drum 12 is provided rotatably at nearly the center in the housing of a copying machine (not shown). There are a main charger 11, which functions as a charging means, a laser exposure device 10, which functions as an exposing means, a developing device 13, which functions as a developing means, a transfer charger 14, which functions as a transfer means, a separation charger 15, a separation claw 16, a cleaning device 17, and a charge elimination lamp 18 provided in order around the photo-conductive drum 12. Further, between the developing device 13 and the transfer charger 14, there is provided an image density sensor 20, which functions as a detecting means.

Above the image forming portion, there are provided a document table (not shown) on which documents are placed, a scanner to read images on the documents placed on this document table, etc. Under the image forming portion, a plurality of paper supply cassettes (not shown) housing a large number of sheets of transfer paper and a paper supply mechanism to take sheets of paper out of these paper supply cassettes and supply to the photo-conductive drum 12 are provided. In addition, a fixing device and other devices (not shown) are arranged at the downstream side of the image forming portion.

Now, the structure of the image forming portion will be described in detail. As shown in FIG. 1, the main charger 11, which charges the surface of the photo-conducive drum 12 uniformly to a specified potential, has a corona wire 11*a* and a grid 11*b* and the corona wire 11*a* is connected with a power source (not shown) which generates corona discharge by applying voltage. Further, the grid 11*b* is connected with a high-voltage transformer 60, which applies grid voltage. The power source and the high-voltage transformer 60 are connected to a CPU 62, which functions as a control means, a decision means and an adjusting means.

With respect to the rotating direction A of the photo-conductive drum 12, at the downstream side of the main charger 11 there is an exposure position 12*a* which is exposed by the laser beam emitted from the laser exposure device 10. As shown in FIG. 1, the laser exposure device 10 performs the main scanning of the surface of the photo-conductive drum 12 along the axial direction B of the photo-conducive drum 12 by the laser beam and according to the rotation of the photo-conductive drum 12, performs the sub-scanning of the surface of the photo-conductive drum 12 along its rotating direction A. The laser exposure device 10 forms an electrostatic latent image corresponding to the image data on the surface of the photo-conductive drum 12 by exposing the exposure position 12*a* of the uniformly charged surface of the photo-conductive drum 12 according to the image data read by a scanner or the image data input from a computer, etc.

The developing device 13 has a developing roller 13*a* which develops the electrostatic latent image formed on the surface of the photo-conductive drum 12 by supplying toner particle that is a developer. The developing bias is applied to the developing roller 13*a* by a high-voltage transformer 76 under the control of the CPU 62.

The transfer charger 14, which transfers a toner image formed on the photo-conductive drum 12 on a paper and the separation charger 15, which separates the paper from the photo-conductive drum 12, are provided at the downstream side of the developing device 13 with respect to the rotating direction A of the photo-conductive drum 12. The transfer charger 14 and the separation charger 15 are formed in one united body and connected to the CPU 62 via high-voltage transformers 68 and 70, respectively.

Between the developing device 13 and the transfer charger 14, an image density sensor 20 is provided to detect the density of the toner image formed on the photo-conductive drum 12. The image density sensor 20 has a light emitting portion (not shown) to emit the detecting light to a specified detecting area on the surface of the photo-conductive drum 12 and a light receiving portion to receive the reflecting light from the surface of the photo-conductive drum 12. The image density sensor 20 transmits the output voltage to the CPU 62 as an image density signal corresponding to the quantity of light received at the light receiving portion. The light emitting portion of the image density sensor 20 is driven by a light source driver 95 under the control of the CPU 62.

There is the separation claw 16 provided at the downstream side of the separation charger 15 and further, the cleaning device 17 having a cleaning blade 78 is provided at the downstream side of the separation claw. The cleaning blade 78 is provided in contact with the surface of the photo-conductive drum 12 and scrapes off the toner that is not transferred and left on the drum surface.

Between the separation claw 16 and the cleaning device 17, a pre-cleaning charger 77 equipped with a corona wire for applying AC power to the photo-conductive drum 12 is provided as an auxiliary cleaning mechanism. This auxiliary cleaning mechanism is provided to reduce the adhesive power of residual toner.

Between the cleaning device 17 and the main charger 11, there is the charge elimination lamp 18. The charge elimination lamp 18 is connected to the CPU 62 via a light source driver 94. The quantity of light of the charge elimination lamp 18 is variable by changing voltage applied to the light source driver 94 under the control of the CPU 62.

At the upper stream side of the transfer portion located between the photo-conductive drum 12 and the transfer charger 14, an aligning roller 46 is provided. The aligning roller 46 conveys a paper supplied from the paper supply mechanism through the transfer portion after aligning the paper. At the downstream side of the transfer portion, a conveyor belt 50 is arranged. The conveyor belt 50 conveys the paper passed through the transfer portion to a fixing device.

In a copying machine in the structure as described above, the CPU 62 examines the quality of an image to be formed. Therefore, an image for the image quality examination is formed on the surface of the photo-conductive drum 12 periodically, for instance, when the power source of a copying machine is turned ON, every time when a specified time passed or specified number of sheets are copied. This image for the quality examination is detected for the image density by the image density sensor 20. Then, the CPU 62 compares the detected image density with a specified reference value. If the detected image density is out of the proper range, the CPU 62 adjusts the charging amount of the main charger 11, the exposing amount by the laser exposure device 10, etc. and controls the entire copying machine so that a specified image density, that is, a specified image quality can be always obtained.

Figure 2:
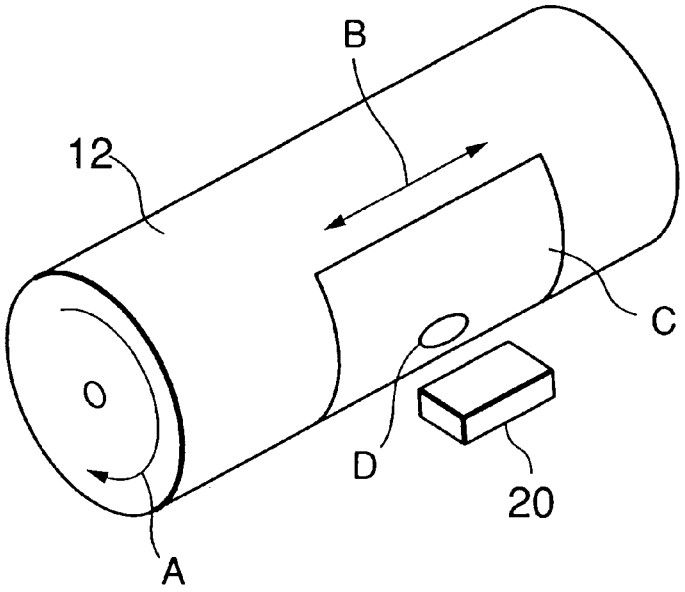
FIG. 2 is a perspective view showing a photo-conductive drum and an image density sensor of the copying machine shown in FIG. 1.
Figure 3:
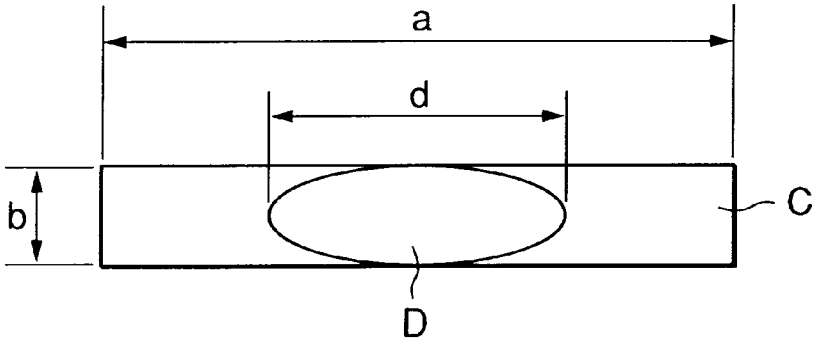
FIG. 3 is a diagram showing the relationship between an image for the quality examination and the detecting area of the image density sensor shown in FIG. 2.

FIG. 2 and FIG. 3 show the state of detecting an examination image C formed on the surface of the photo-conductive drum 12 by the image density sensor 20. There is a nearly oval shaped detecting area D on the surface of the photo-conductive drum 12 and the image density sensor 20 is able to detect the density of an image formed on the detecting area D.

In order to detect the image density of the examination image D accurately, the length a of the examination image along the axial direction of the photo-conductive drum 12 must be the same as the length d of the detecting area D or more than it. However, if the length a of the examination area C is made large unnecessarily, the toner consumption in detecting the image density increases unnecessarily and not desirable from the economical viewpoint. Further, if the examination image C is always set at a constant size, the detecting area D does not become constant because of a solid difference between a copying machine itself and the image density sensor 20. As a result, the examination image C and the detecting area D do no agree with each other and the accurate detection becomes difficult.

So, according to a copying machine in this embodiment, when assembling, shipping or performing the maintenance of a copying machine, the examination image C is adjusted to a minimum size so as to agree with the detecting area D of the image density sensor 20. In other words, the image forming area of the examination image C is so adjusted that the examination image C is formed at a position where it is superposed on the detecting area D and furthermore, its length becomes the same as that of the detecting area or slight larger than it.

Figure 4:
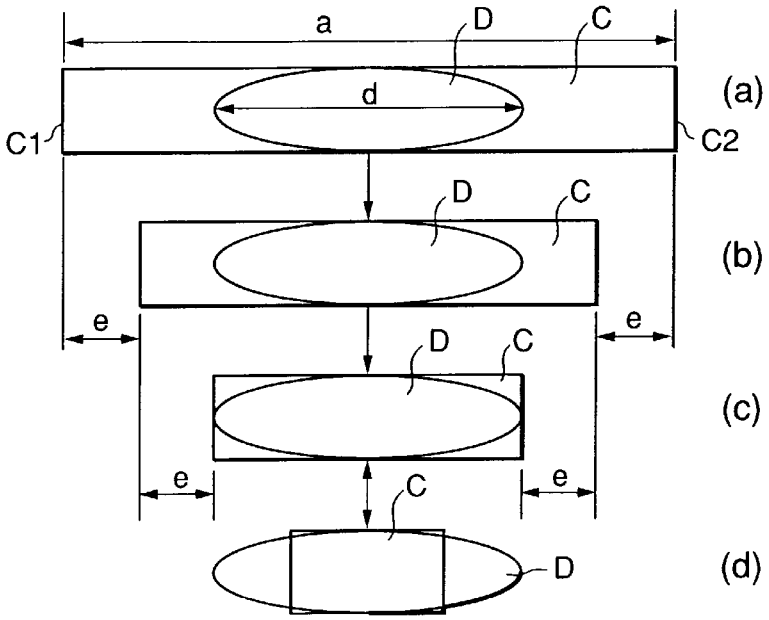
FIG. 4 is a diagram showing a first embodiment of the step to decide the image forming area for the image quality examination shown in FIG. 3 at an optimum size by making the area small gradually.
Figure 5:
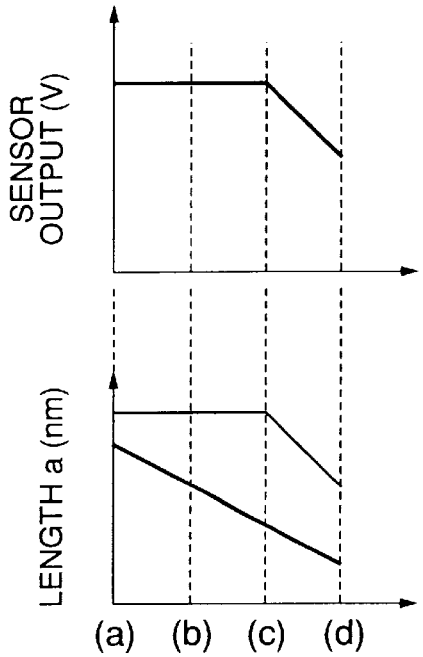
FIG. 5 is a graph showing the output values of the image density sensor and lengths of the image forming area, respectively when the image forming area for the image quality examination shown in FIG. 4 is made small gradually.

In this case, as a first embodiment shown in FIG. 4 and FIG. 5, the CPU 62 first forms the examination image C having the sufficiently larger length a than the length d of the detecting area D on the surface of the photo-conductive drum 12. The examination image C is detected by the image density sensor 20 and the detection output at this time is made as a reference value. Then, the exposure range by the laser exposure device 10 is made small gradually by a variable minimum size e at a time. In other words, an exposure starting position C1 (a first edge) and an exposure ending position C2 (a second edge) in the main scanning direction by the laser exposure device 10 are made small by the minimum size e at a time in the direction getting near the detecting area D, respectively so as to make the length a of the examination image C small gradually.

Then, whenever the examination image C is made small, the image density of the examination image is detected by the image density sensor 20 and the detection output is compared with the reference value described above. If the detection output is the same as the reference value, the length a of the examination image C is further made small as shown in FIG. 4(*c*). Thereafter, when the examination image C becomes smaller than the detecting area D, the detection output of the image density sensor 20 also becomes smaller than the reference value as shown in FIG. 4(*d*). Then, the CPU 62 decides that the examination image C at the immediately before stage is most resemble to the detecting area D of the image density sensor 20 and a minimum examination image from which the image density is detectable. The CPU 62 stores the exposure range of the laser exposure device 10 at the time in a memory 93 as an examination image forming area.

Thereafter, when user performs a periodical examination of image quality when using a copying machine, the CPU 62 exposes the surface of the photo-conductive drum 12 according to the exposure range decided and stored in the memory 93 as described above and forms a minimum sized examination image C resembled to the detecting area D of the image density sensor 20. Accordingly, it is possible to suppress a toner amount that is used in the image quality examination of a copying machine to the minimum. Furthermore, it is also possible to accurately detect an image density as the detection area D of the image density sensor 20 and the examination image C certainly agree with each other.

Figure 6:
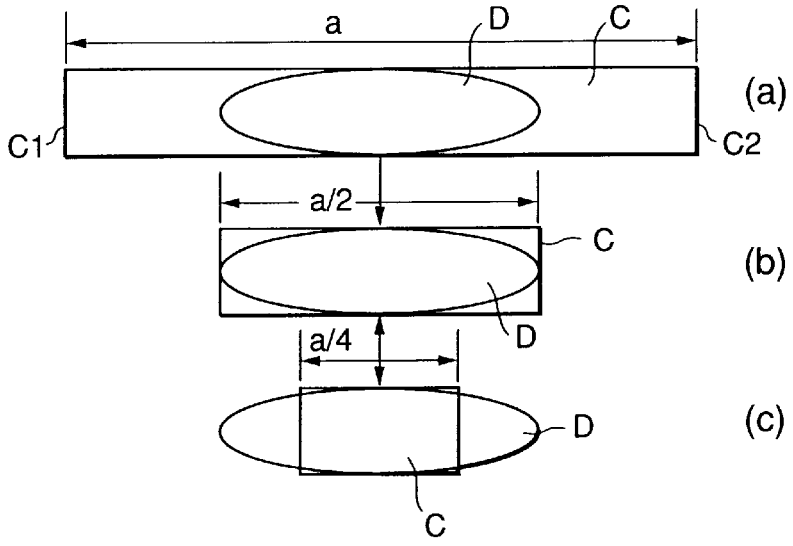
FIG. 6 is a diagram showing a second embodiment of the step to decide the image forming area for the image examination shown in FIG. 3 at an optimum size by making the area small gradually.
Figure 7:
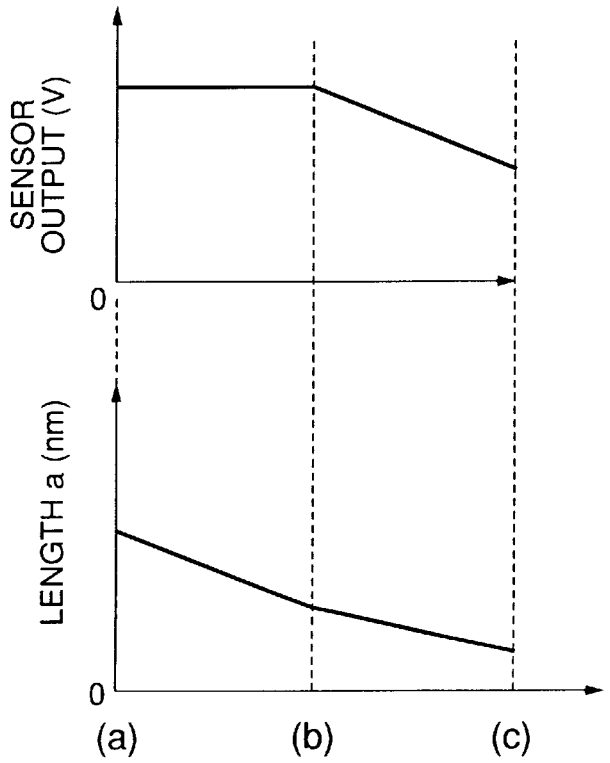
FIG. 7 is a graph showing the output values of the image density sensor and the lengths of the image forming area, respectively when the image forming area for the quality examination shown in FIG. 6 was made small gradually.

In the above first embodiment, a method shown is to make the exposure range small for every minimum variable size e of the laser exposure device 10. Further, as a second embodiment, the exposure starting position C1 and the exposure ending position C2, which become the first and the second edges of the examination image forming area may be made small by, for instance, changing the exposure starting position C1 and the exposure ending position C2 simultaneously so that they are changed by ½ of the length of the exposure range at a time as shown in FIGS. 6 and 7. In this case, the CPU 62 decides the exposure range shown in FIG. 6(*b*) as the optimum size of the examination image C. And it is possible to reduce a time required for deciding the optimum exposure range by making the width of the exposure range to be changed at each stage large.

In the first and second embodiments shown above, a method shown is to decide the exposure range by simultaneously changing both the exposure starting and ending positions. However, although this method is effective when the center of the examination image C along the axial direction of the photo-conductive drum 12 and the center of the detecting area D of the image density sensor 20 are in accord with each other, if these centers O1, O2 are not in accord with each other as shown in FIG. 8(*a*), the decided exposure range becomes unnecessarily large and toner will be consumed wastefully.

Figure 8:
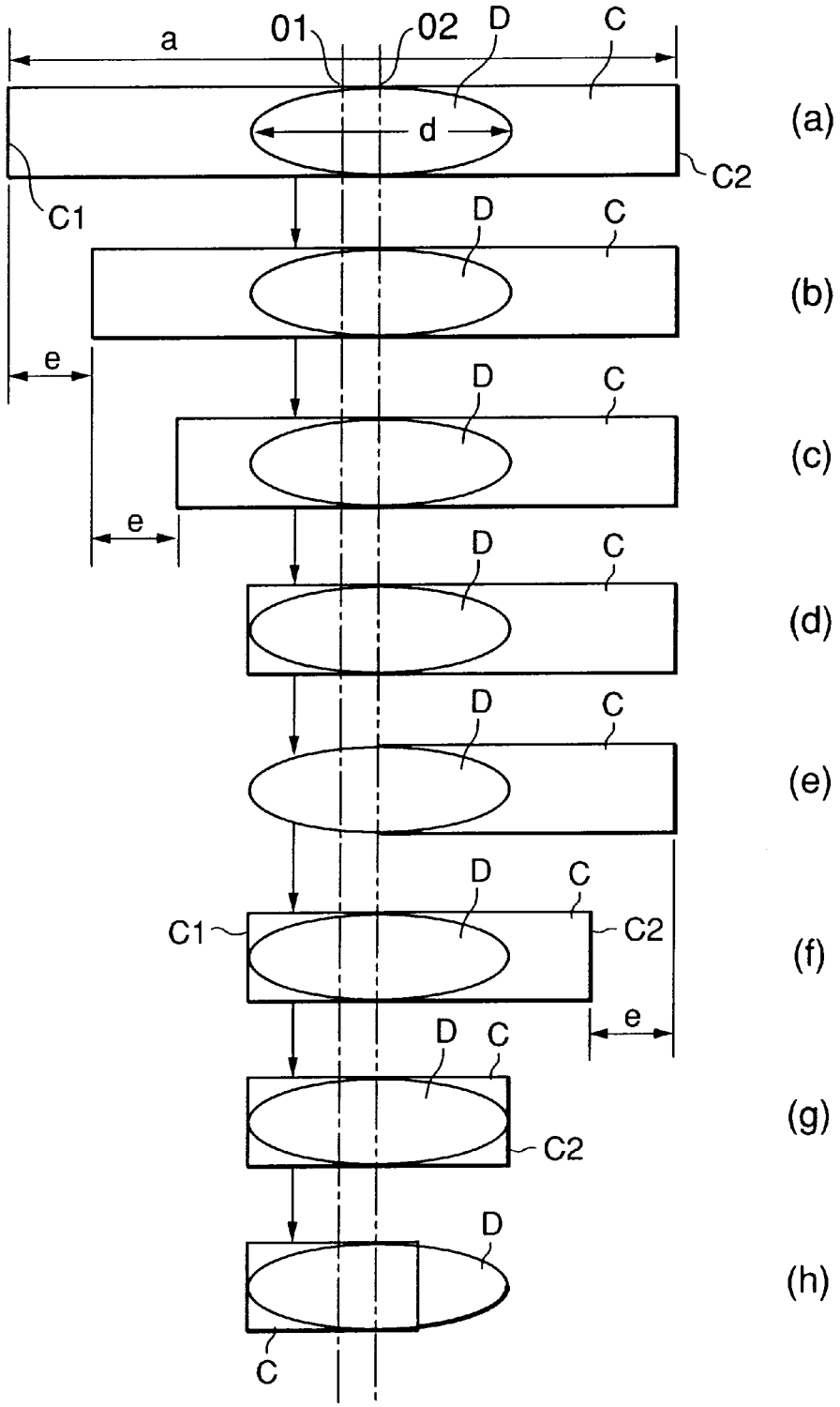
FIG. 8 is a diagram showing a third embodiment of the step to decide an optimum size by making the image forming area for the image quality examination small gradually by one side each.
Figure 9:
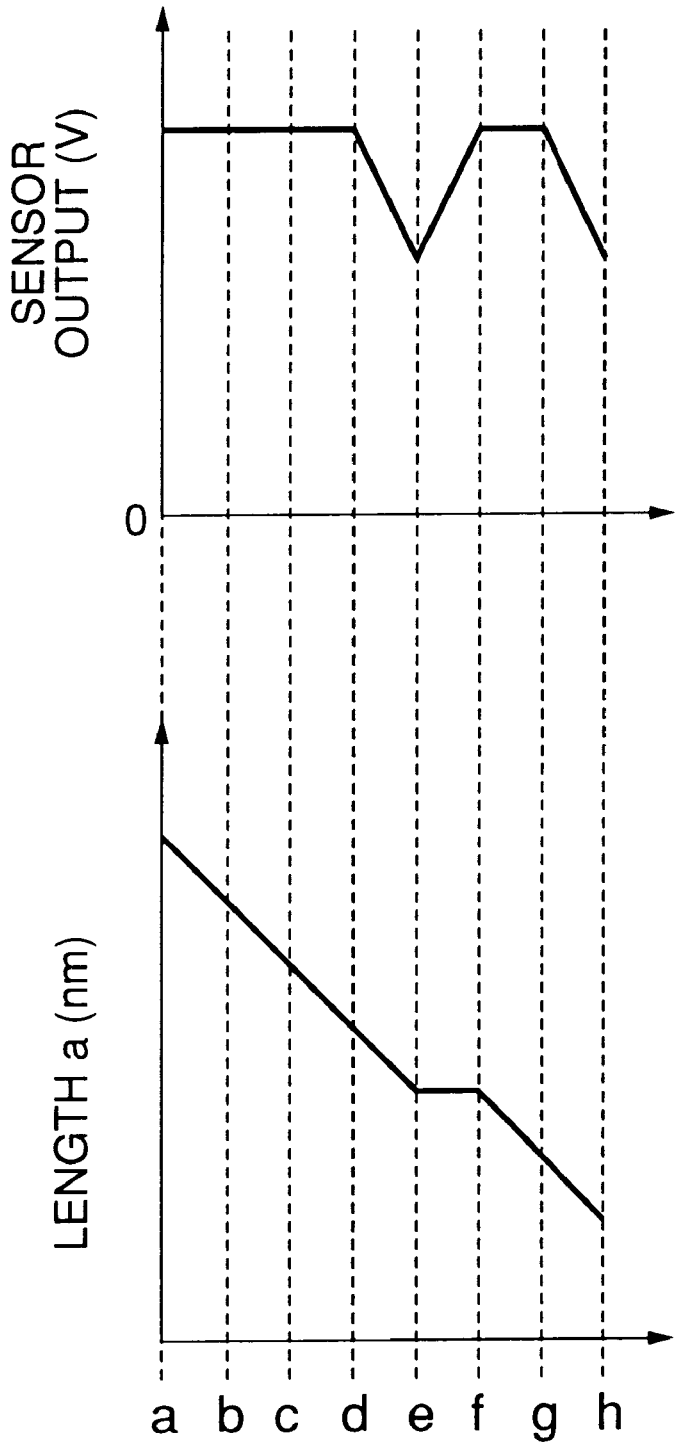
FIG. 9 is a graph showing the output values of the image density sensor and the lengths of the image forming area, respectively when the image forming area for the image quality examination showing in FIG. 8 is made small gradually.

So, as a third embodiment, the CPU 62 first forms the examination image C having a sufficiently larger length a than the length d of the detecting area D on the surface of the photo-conductive drum 12 as shown in FIG. 8(*a*) and FIG. 9. Then, the examination image C is detected by the image density sensor 20 and the detection output at the time is made as a reference value.

In succession, as shown in FIG. 8(*b*) through FIG. 8(*e*), the exposure starting position C1 in the main scanning direction by the laser exposure device 10 is changed gradually in the direction getting close to the detecting area D by a variable minimum size at a time to make the length a of the examination image C small gradually.

Whenever the examination image C is small, the CPU 62 detects the image density of the examination image by the image density sensor 20 and compares its detected output with the reference value described above. Then, when the detected output becomes smaller than the reference value, the CPU 62 judges that the exposure starting position C1 at the immediately preceding stage (FIG. 8(*d*)) is most close to the detecting area D of the image density sensor 20 and the optimum position, and deciding it as the exposure starting position of the exposure range for forming the examination image, stores this exposure starting position in the memory 93.

In succession, as shown in FIGS. 8(*f*) through 8(*h*), the CPU 62 changes the exposure ending position C2 in the main scanning direction by the laser exposure device 10 gradually in the direction getting close to the detecting area D by the variable minimum size e at a time to make the length a of the examination image C small gradually.

Whenever the examination image C is made small, the CPU 62 detects the image density of the examination image by the image density sensor 20. When the detected output becomes smaller than the reference value, the CPU 62 judges that the exposure ending position C2 at the immediately preceding stage (FIG. 8(*g*)) is most close to the detecting area D of the image density sensor 20 and the optimum position, and deciding it as the exposure ending position of the exposure range for forming the examination image, stores this exposure ending position in the memory 93.

By the operations described above, the exposure starting and ending positions to form the examination image C, that is, the exposure range is decided. Thereafter, when user performs a periodical examination of image quality when operating a copying machine, the CPU 62 exposes the surface of the photo-conductive drum 12 according to the exposure range thus decided and stored in the memory 93. After this exposure, the minimum sized examination image C resembled to the detecting area D of the image density sensor 20 is developed and formed. Therefore, even when the center of the examination image and the center of the detecting area of the image density sensor are not in accord with each other, it is possible to suppress toner amount that is consumed in the image quality examination of a copying machine to the minimum level. Furthermore, the detecting area D of the image density sensor 20 surely agrees with the examination image C and it is possible to perform the accurate image density examination.

Figure 10:
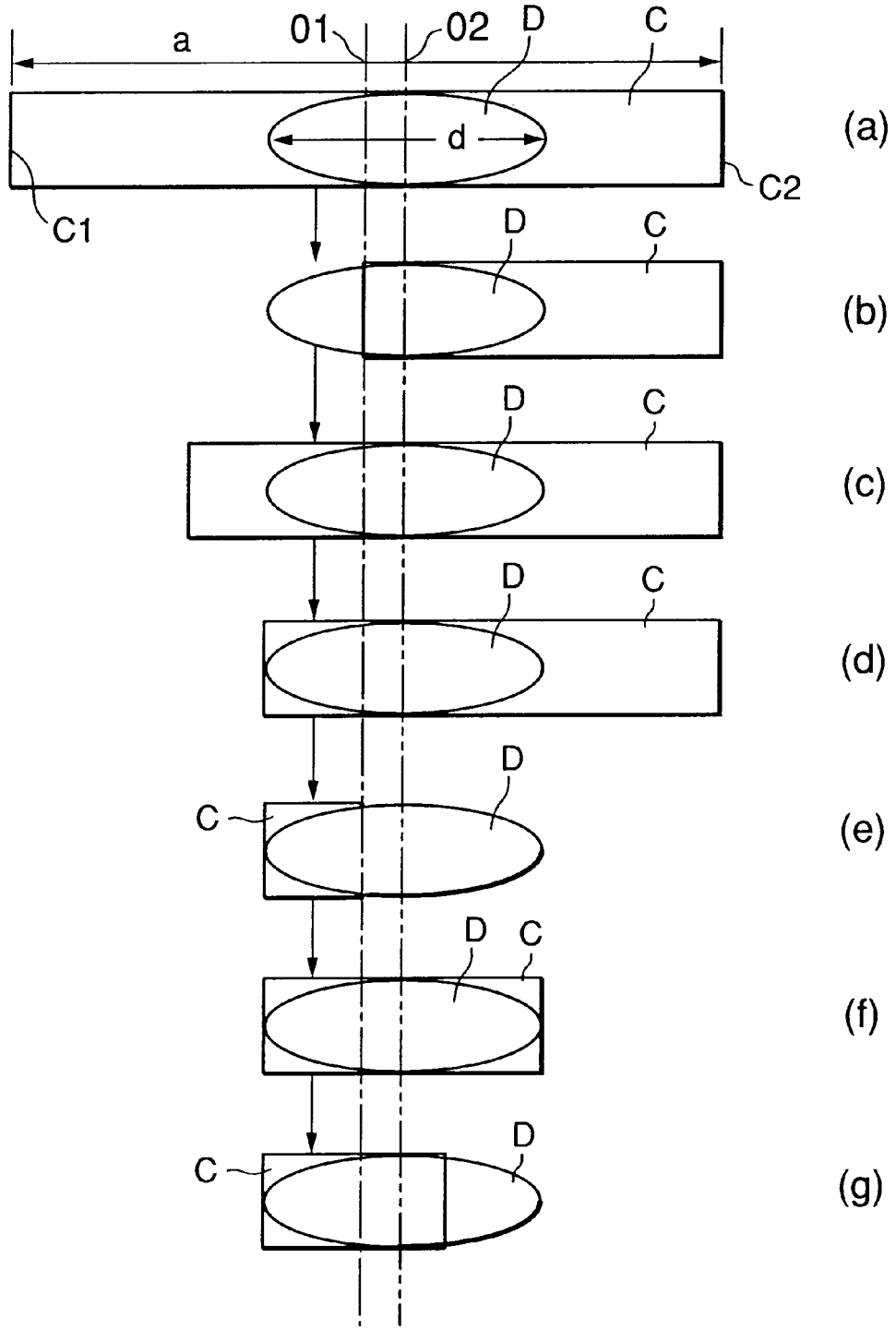
FIG. 10 is a graph showing a fourth embodiment of the output values of the image density sensor and the lengths of the image forming area, respectively when the image forming area for the image quality examination shown in FIG. 10 is made small gradually.
Figure 11:
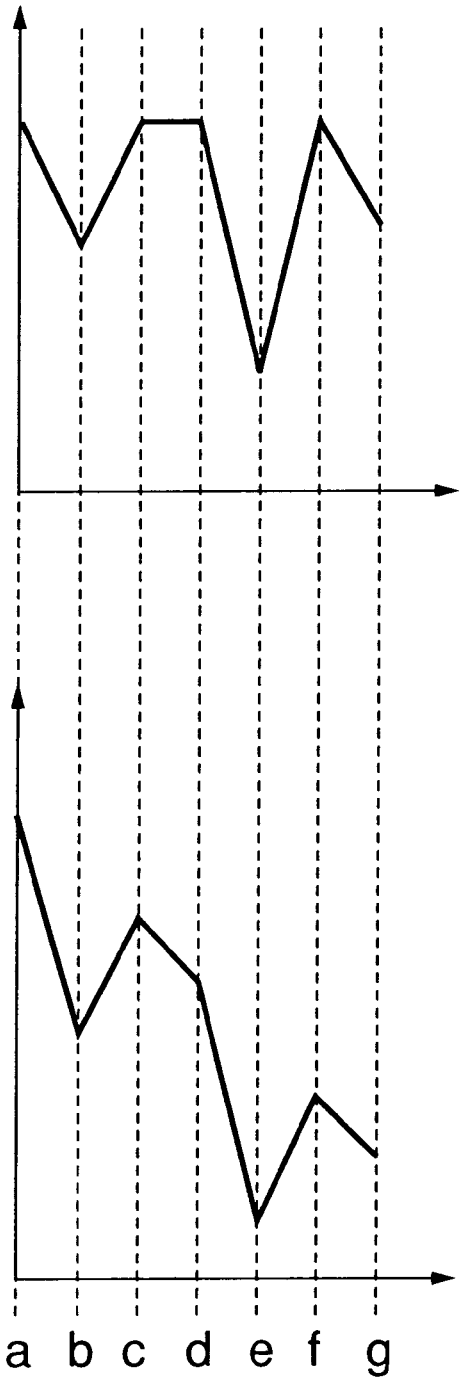
FIG. 11 is a graph showing the output values of the image density sensor and the lengths of the image forming area when the image forming area for the image quality examination shown in FIG. 10.

In the third embodiment shown in FIG. 8 and FIG. 9, a method shown is to make an exposure size small for every minimum variable size e of the laser exposure device. However, as a fourth embodiment, the exposure starting position C1 and the exposure ending position C2 may be changed gradually so that, for instance, the length a of the exposure range is changed by ½ at a time as shown in FIG. 10 and FIG. 11. In this case, the CPU 62 decides the exposure range shown in FIG. 10(*f*) as the optimum size of the examination image C. Then, by reducing the number of changes by making the change width of the exposure range in each stage large, it is possible to reduce a time required for deciding the optimum exposure range.

Next, a method to decide a size of the examination image C along the rotating direction A of the photo-conductive drum 12 will be described.

When detecting the image density of the examination image C by the image density sensor 20, a detected value of the image density may vary according to the uneven charge of the photo-conductive drum 12, uneven development, uneven rotation of the photo-conductive drum, etc. Therefore, image density is detected at n-points of one examination image C and a mean value of these detected values is used as the detected value.

Figure 13:
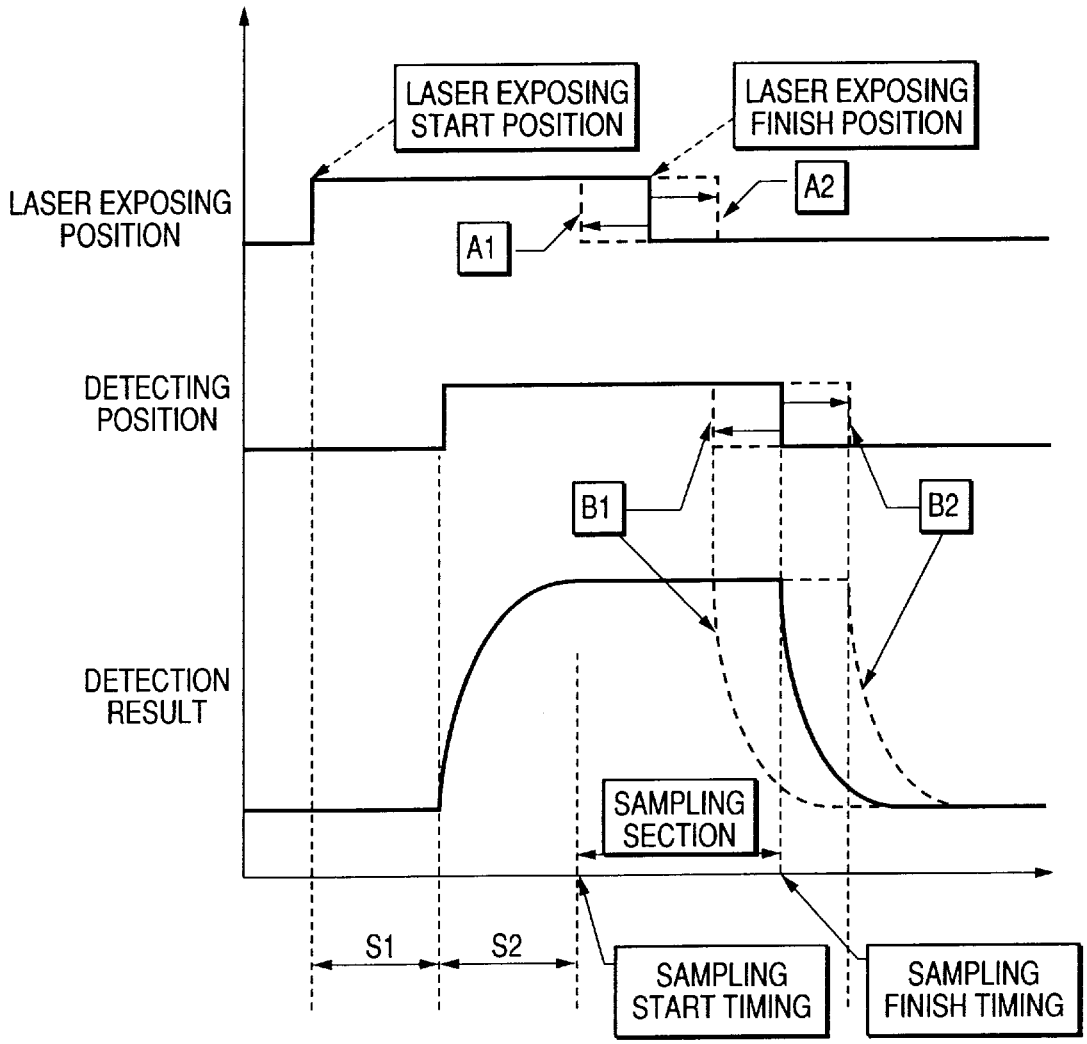
FIG. 13 is a graph showing the exposure starting and ending timings, the detecting timing by the image density sensor and the detection output by a laser exposing device of the copying machine sown in FIG. 1.

FIG. 13 shows the exposing timing at the laser exposing position, the detecting timing of the image density sensor 20 at the image density detecting position and the detected result of the image density sensor (the detected output) in the laser exposure range on the photo-conductive drum 12 by the laser exposure device 10.

The examination image formed by the exposure by the laser exposure device 10 and the development by the developing device 13 arrives at the detecting area D of the image density sensor 20 delayed by a time S1 from the start of the exposure by the laser exposure device 10. At this time, the detected result is not stabilized at the initial stage of the examination by the image density sensor 20 and a time S2 is further needed until the detected result is stabilized. So, a time (S1+S2) until the detected result by the image density sensor 20 from the start of exposure by the laser exposure device 10 is measured. This measured time (S1+S2) is decided as a sampling start timing by the image density sensor 20 and this time is stored in the memory 93.

Then, as it is needed to sample detected values of the image density at n-times after the sampling is started, the examination image C must be formed before completing the detection of n-times. For instance, as shown by A1, if the laser exposure ending position, that is, the examination image ending position is too early, the examination image is completed during the sampling as shown by B1. Further, if the laser exposure ending position is too late as shown by A2, the examination image not required for the sampling is formed and toner is consumed wastefully.

So, when deciding a size of an examination image C along the rotating direction A, an examination image C in a sufficiently large size is first formed in the rotating direction A of the photo-conductive drum 12. From this examination image C, the image density is sampled by n-times and a mean value of the sampled image densities is made as the standard value. In succession, the laser exposure ending timing is advanced by a specified time so as to make a size of an examination image along the rotating direction A small and the image density of the examination image is detected. Then, the detected value is compared with the reference value and if they are the same, the laser exposure ending timing is further advanced by a specified time and the image density of the examination image is detected. Thus, when the laser exposure ending timing is advanced gradually, the size of the examination image is made small and the detected value becomes smaller than the reference value, the laser exposure ending timing at the immediately preceding stage is adopted as the optimum laser exposure ending timing.

By the above operations, the size of the examination image C along the rotating direction A of the photo-conductive drum 12 and the sampling starting and ending timings are set at the optimum levels. Thus, it becomes possible to make the certain image quality examination without causing the wasteful toner consumption.

Figure 12:
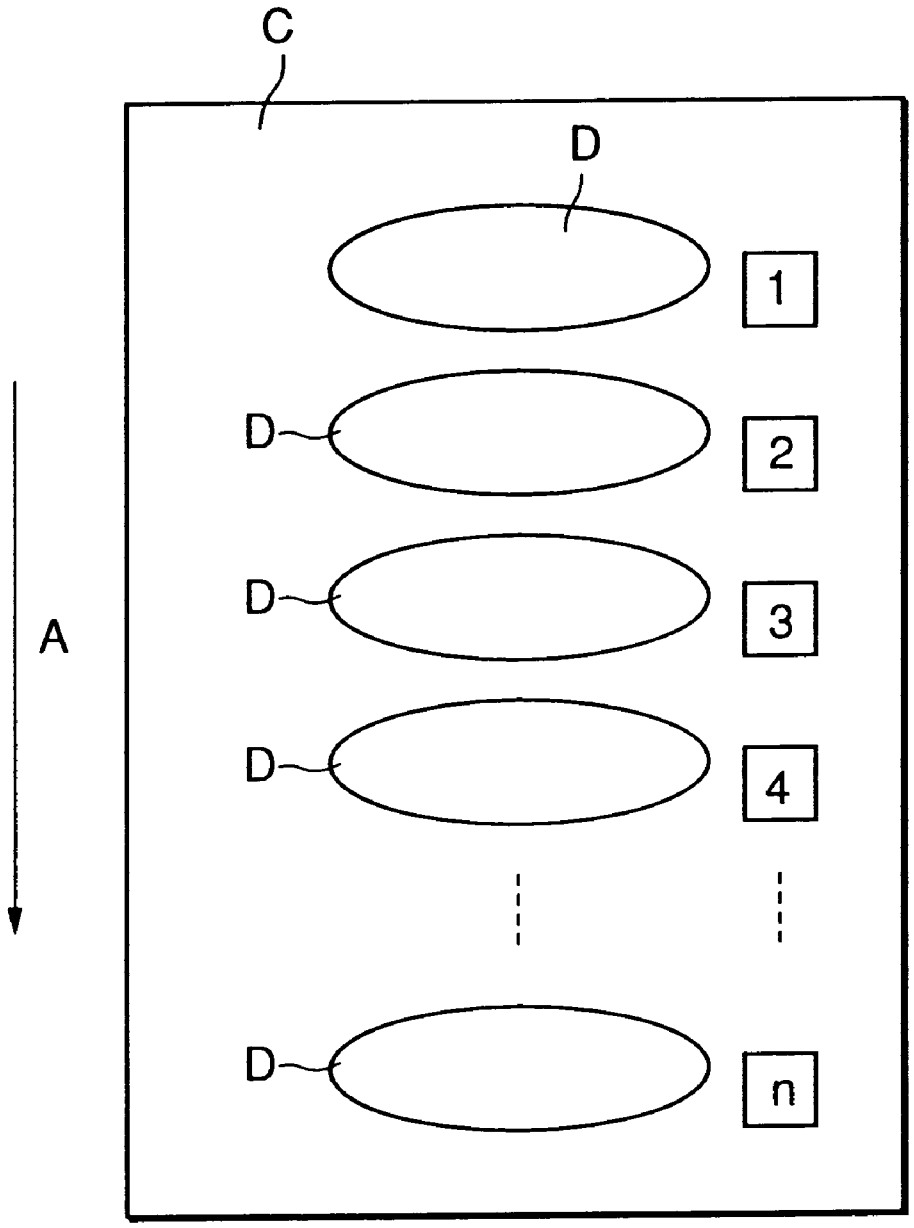
FIG. 12 is a diagram showing the step to decide sizes of the image forming area for the image quality examination along the rotating direction of the photo-conductive drum.

Further, in the step in FIG. 12, the method shown is to form a large examination image first and then, decide an optimum timing by advancing the laser exposure ending timing gradually. On the contrary, however, an optimum laser exposure ending timing at which a detected value of the image density sensor is stabilized may be decided by forming a small examination image first and then, delaying the laser exposure ending timing gradually.

Although the image density sensor 20 was used in many embodiments shown above as a detecting means to detect the quality of examination image, a detecting means is not restricted to this image density sensor 20 but a surface potential sensor may be used.

Figure 14:
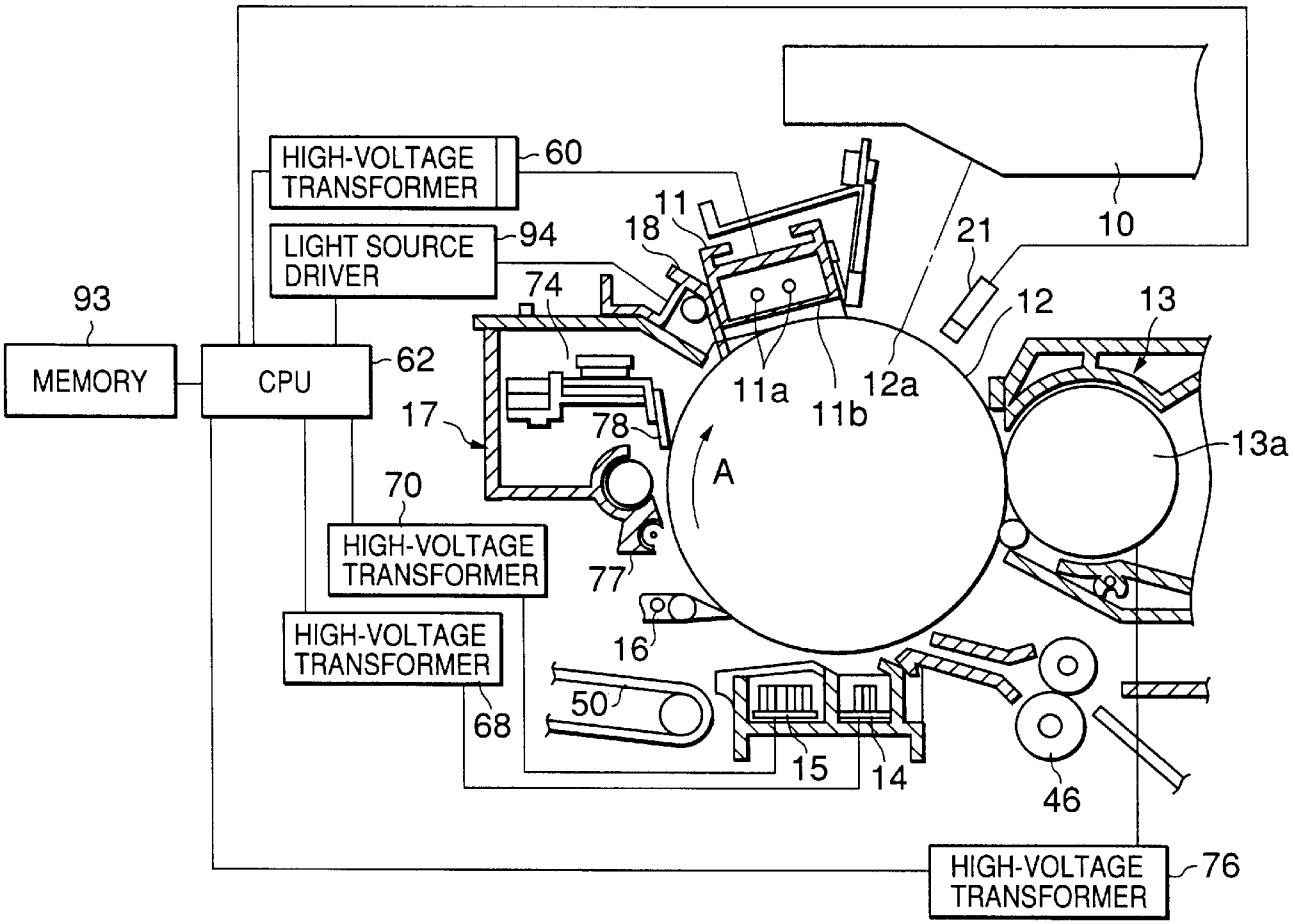
FIG. 14 is a schematic diagram showing the image forming portion of the digital copying machine showing the second embodiment of the present invention.

In this case, a surface potential sensor 21 is provided between the exposure position 12*a* and the developing device 13 against the photo-conductive drum 12 as shown in FIG. 14. Component elements other than the image forming potion are all in the same structure as that of the first embodiment and the same component elements are assigned with the same reference numerals and the detailed explanation thereof is omitted.

An optimum exposure range is decided by changing the exposure range set by the laser exposure device 10 gradually likewise the first through the fourth embodiments described above while detecting the surface potential of the photo-conductive drum 12 by the surface potential sensor 21. As a result, it becomes possible to obtain a copying machine that is capable of detecting the image quality change without consuming wasteful toner.

Figure 15:
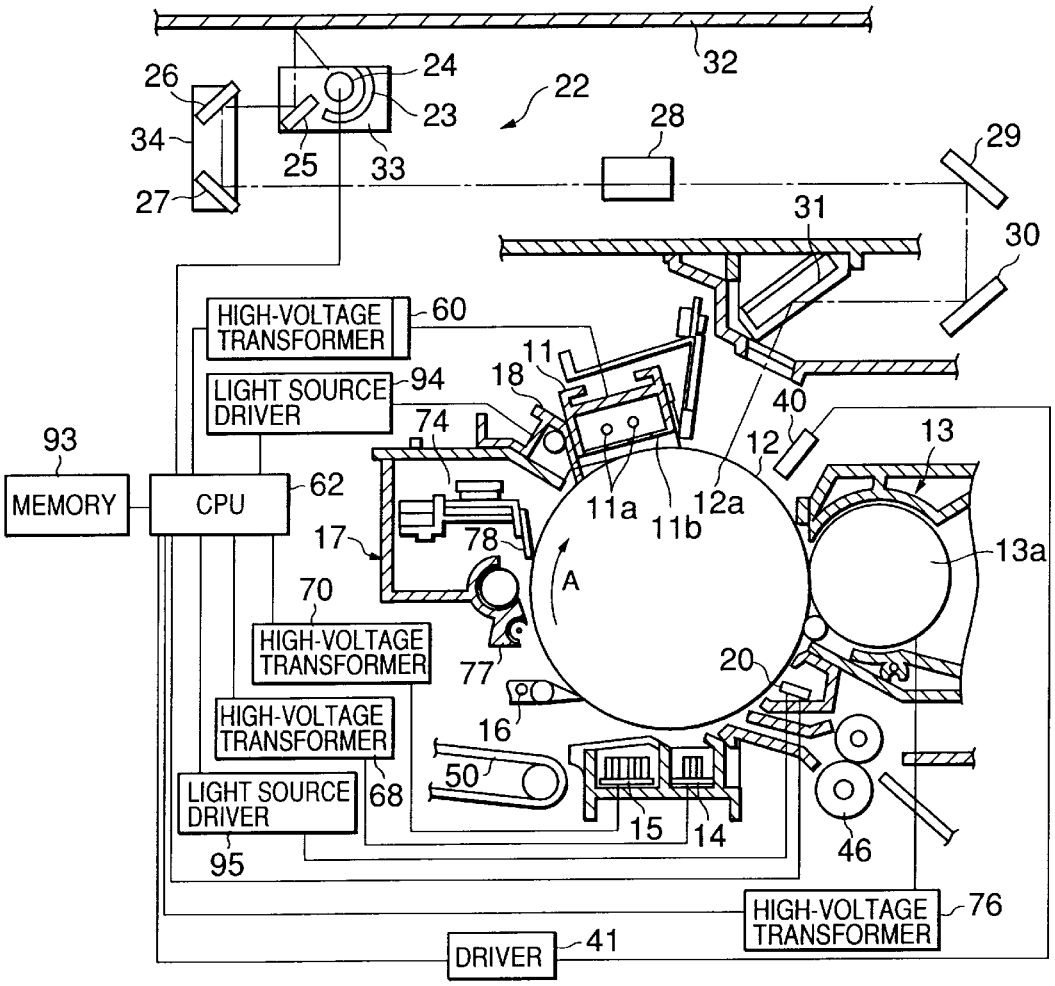
FIG. 15 is a schematic diagram showing the image forming portion of the analog copying machine showing the third embodiment of the present invention.

In the second embodiment, a so-called digital copying machine equipped with a laser exposure device is described. However, the present invention is not limited to a digital copying machine but is also applicable to an analog copying machine. As shown in FIG. 15, an analog copying machine differs in the structure of the exposure device from a digital copying machine.

That is, according to the analog copying machine described in the third embodiment, under a document table 32 comprising a transparent glass, there is provided a scanner 22 which reads an image of a document placed on the document table 32. The scanner 22 is equipped with an exposure lamp 24 of which back is enclosed by a reflector 23 and a first mirror 25 that is placed on a first carriage 33 jointly with the exposure lamp 24. Further, the scanner 22 has a second and a third mirror 26 and 27 that are placed on a second carriage 34 and movable jointly in one united body, a lens 28 and first, fifth and sixth fixed mirrors 29, 30 and 31.

The first and the second carriages 33 and 34 are moved along the document table 32 at a specified speed and scan the document by the light applied from the exposure lamp 24. Then, the reflecting light from the document is led to the photo-conductive drum 12 by the first through the sixth mirrors and the lens 28, and exposes the surface of the photo-conductive drum 12.

Likewise a digital copying machine, around the photo-conductive drum 12, there are the main charger 11, the developing device 13, the transfer charger 14, the separation charger 15, the separation claw 16, the cleaning device 17 and the charge elimination lamp 18 provide in order. Between the developing device 13 and the transfer charger 14, there is provided the image density sensor 20, which functions as a detecting means. Further, the main charger 11 and the scanner 22 comprise a latent image forming means in the present invention.

In an analog copying machine, when exposing the surface of the photo-conductive drum 12 and forming an electrostatic latent image, a toner adheres to portions that are not exposed, that is, those portions not charge eliminated and a latent image is developed. Therefore, an LED array 40 which functions as charge eliminating means is provided between the exposure position 12*a* and the developing device 13 on the surface of the photo-conductive drum 12.

Figure 16:
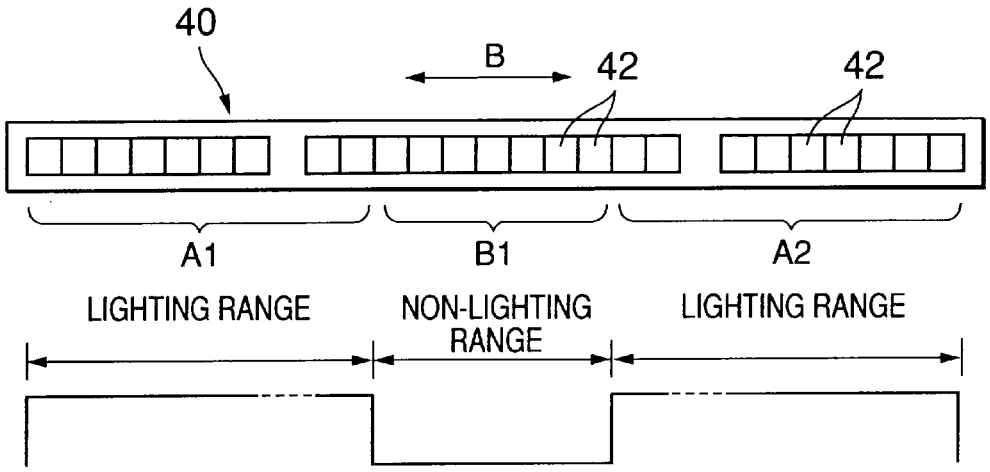
FIG. 16 is a diagram showing an LED array and its lighting and non-lighting ranges of the analog copying machine shown in FIG. 15.

As shown in FIG. 15 and FIG. 16, the LED array 40 has a number of light emission elements 42 provided in parallel with the axial direction of the photo-conductive drum 12. The LED array 40 is connected to the CPU 62 via a driver 41 which serves as a driving portion. Under the control of the CPU 62, it is possible to selectively eliminate the charge on the surface of the photo-conductive drum 12 by selectively emitting the light from the light emission elements 42. In other words, the portions applied with the light from the light emission elements 42 on the surface of the photo-conductive drum 12 charged by the main charger 11 are discharged and the surface potential drops.

Other component elements are the same as the second embodiment and the same component elements are assigned with the same reference numerals and the detailed explanation thereof will be omitted.

In an analog copying machine in the structure as described above, the size of an examination image that is formed in order to detect the image quality change and its forming position can be decided in the optimum state by changing the charge elimination area on the surface of the photo-conductive drum 12 by adjusting the light emission range of the LED 40.

Figure 17:
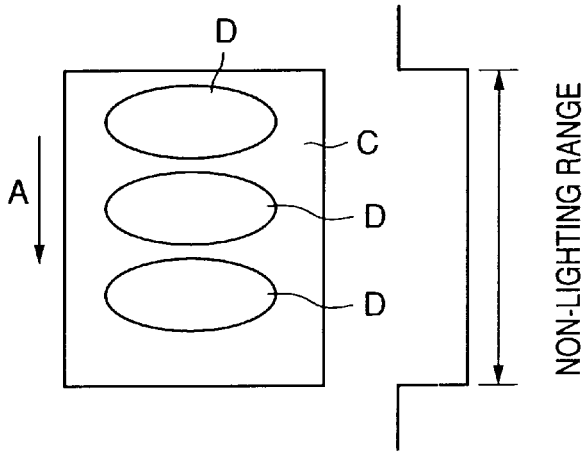
FIG. 17 is a diagram showing the steps to decide the image forming area for the image quality examination using the LED array shown in FIG. 16.

In this case, as shown in FIG. 16 and FIG. 17, the light emission elements 42 of the LED array 40 are first selectively turned ON so that a non-lighting range B1 which is sufficiently longer than the detecting area D of the image density sensor 20 and lighting ranges A1 and A2 are provided at both sides of this non-lighting range. Of the surface of the photo-conductive drum 12, portions opposite to the lighting ranges A1 and A2 are charge eliminated and become a first and a second charge eliminated areas, respectively and a portion opposite to the non-lighting range B1 becomes the examination image C forming area.

Then, while detecting the image density of the examination image C by the image density sensor 20, the widths of the first and second charge eliminated areas along the axial direction of the photo-conductive drum 12 are made large by increasing the widths of the lighting ranges A1 and A2 gradually and on the contrary, the width of the examination image C forming area is made small gradually. Here, likewise the digital copying machine, the widths of the first and second charge eliminated areas may be changed simultaneously or separately.

Then, the widths of the first and second charge eliminated areas at the stage immediately before a detected value of the image density sensor 20 becomes smaller than a specified reference value are adopted as the optimum values and the width of the image forming area is decided. Further, the size of the examination image C along the rotating direction A of the photo-conductive drum 12 is decided according to the same method as in the above step with reference to FIG. 12.

Also, in an analog copying machine in the structure described above, a size, forming position and sampling starting and ending timings can be set at the optimum level corresponding to the detecting area D of the image density sensor 20. Accordingly, user of a copying machine is able to perform the certain image quality examination without consuming toner wastefully.

Figure 18:
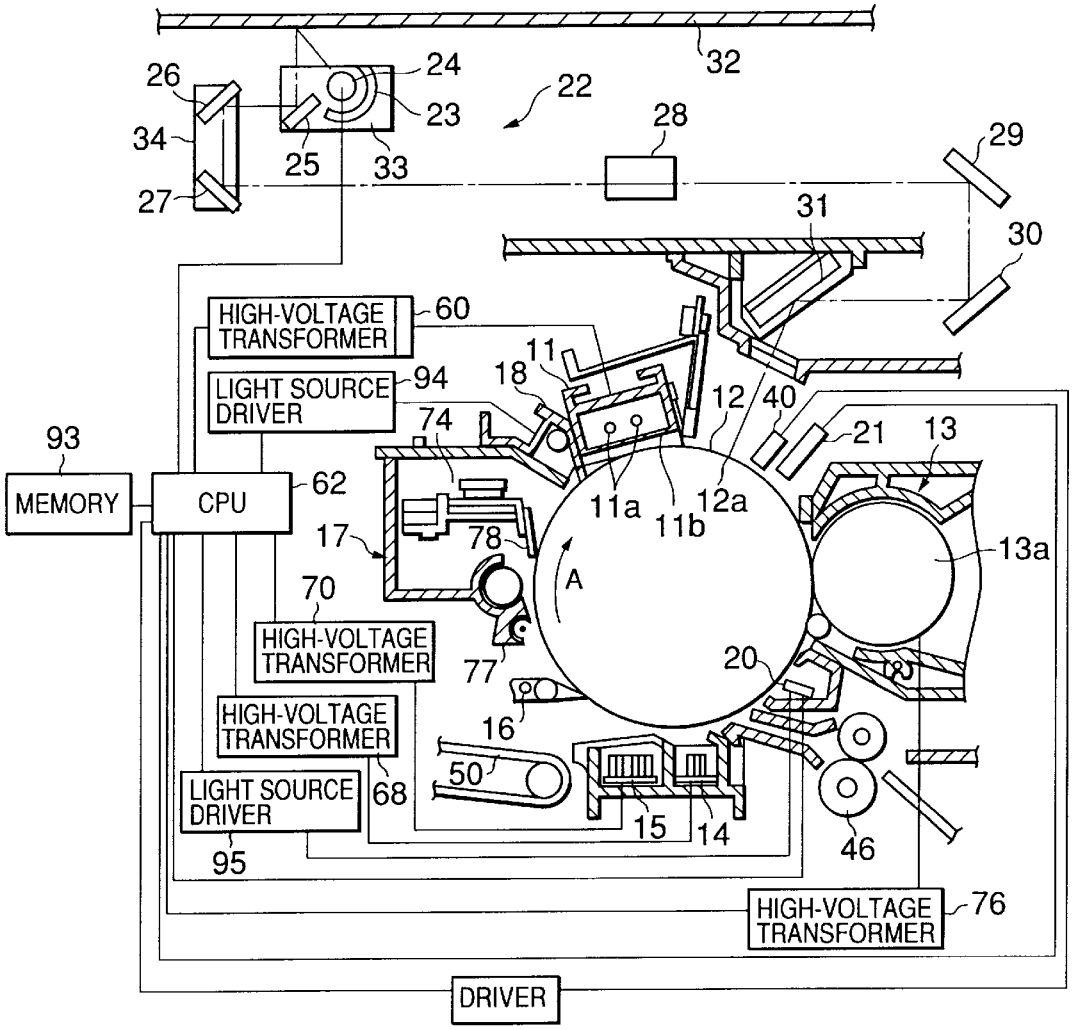
FIG. 18 is a schematic diagram showing the image forming portion of the analog copying machine showing the fourth embodiment of the present invention.

Further, in the analog copying machine described above, the image density sensor 20 was used as a detecting means but a surface potential sensor can be used for the image density sensor. In this case, as shown in the fourth embodiment in FIG. 18, the surface potential sensor 21 is provided between the LED array 40 and the developing device 13 against the photo-conductive drum 12.

Then, it is possible to decide an optimum examination image forming area by changing the charge elimination range by the LED arrange 40 gradually likewise the third embodiment while detecting the surface potential of the examination image forming area of the photo-conductive drum 12 by the surface potential sensor 21. Thus, it becomes possible to obtain a copying machine that is capable of detecting the image quality change without consuming toner wastefully. Other component elements are the same as those in the third embodiment and the same component elements are assigned with the same reference numerals and the detailed explanation thereof is omitted.

Further, the present invention is not restricted to the embodiments described above and can be variously changed without departing from the spirit and scope of the invention. For instance, in the above-mentioned embodiments, the size and the position of the examination image forming area is fitted to the detecting area of the detecting means by adjusting the exposure range or the charge elimination range. On the contrary, however, the detecting range of the detecting means may be fitted to the examination image forming area by adjusting the position of the detecting means after setting the size of the forming area to an optimum value in advance.

As described in detail in the above, according to the present invention, the minimum examination image forming area that is nearly in accord with the detecting area of the image quality detecting means is decided by adjusting the examination image forming area according to the detecting area of the image quantity detecting means. Accordingly, it is possible to provide an image forming apparatus that is capable of surely detecting the image quality change without increasing consumption of developer when starting the operation or performing the image quality examination periodically.

What is claimed is:

1. An image forming apparatus comprising:

means for exposing a surface of an image carrier to form an electrostatic latent image on the image carrier;

means for developing the electrostatic latent image to form a developer image on the image carrier;

means having a specified detecting area on the image carrier for detecting a quality change of the developer image formed on the detecting area; and means for deciding a minimum examination image forming area which is nearly in accord with a detecting area of the detecting means by changing the examination image forming area according to the detecting result of the detecting means.

2. An apparatus according to claim 1, wherein the deciding means decides a size of the examination image forming area to the size at the stage immediately before an examination result becomes out of a specified value by reducing the size of the examination image forming area gradually according to a detection result of the detecting means.

3. An apparatus according to claim 1, wherein the examination image forming area has a first edge positioned at one side of the detecting area and a second edge positioned at the opposite side of the first edge with the detecting area put between them;

the deciding means reduces the size of the examination image forming area in the direction where the first edge of the examination image forming area is getting close to the detecting area according to a detection result of the detecting means and after deciding the position of the first edge at the stage immediately before an examination result becomes out of a specified value, reduces the size of the examination image forming area gradually in the direction where the second edge of the examination image forming area is getting close to the detecting area and decides the position of the second edge at the stage immediately before an examination result becomes out of a specified value.

4. An apparatus according to claim 1, wherein the exposing means and developing means forms continuous examination images along the specified direction on the surface of the image carrier, and the deciding means decides a detection starting timing by the detecting means and decides an examination image forming ending position according to a detection result from the detecting means.

5. An apparatus according to claim 1, further comprising:

adjusting means for automatically adjusting an amount of exposure of the exposing means according to a detecting result of the detecting means so that an examination image, which is formed by the exposing means and the developing means in the examination image forming area decided by the deciding means, has a specified image quality.

6. An image forming apparatus comprising:

a photo-conductive drum being rotatable in a specified direction;

charging means for charging a surface of the photo-conductive drum;

exposing means for exposing and scanning the surface of the photo-conductive drum along the axial direction of the photo-conductive drum to form an electrostatic latent image on the photo-conductive drum;

developing means for developing the electrostatic latent image to form a developer image on the photo-conductive drum;

transfer means for transferring the developer image from the photo-conductive drum onto an image receiving medium;

detecting means having a specified detecting area on the photo-conductive drum for detecting a quality change of the developer image formed on the detecting area; and decision means for deciding a minimum examination image forming area which is nearly in accord with the detecting area of the detecting means by changing the examination image forming area according to a detecting result of the detecting means.

7. An apparatus according to claim 6, wherein the decision means reduces an exposure range by the exposing means from an initial range larger than the detecting area and including an examination area gradually and decides the examination area at the stage immediately before an examination result comes out of a specified value.

8. An apparatus according to claim 6, wherein the decision means changes an exposure starting position by the exposing means in the direction getting close to the detecting area gradually and after deciding the exposure starting position at the stage immediately before an examination result becomes out of a specified value, changes an exposure ending position by the exposing means in the direction getting close to the detecting area gradually and decides the exposure ending position at the stage immediately before an examination result becomes out of a specified value.

9. An apparatus according to claim 6, wherein the exposing means and developing means form continuous examination images along the specified direction on the surface of the photo-conductive drum, and the decision means decides a detection starting timing by the detecting means and decides an examination image forming ending position according to a detection result from the detecting means.

10. An apparatus according to claim 6, further comprising:

adjusting means for automatically adjusting an amount of exposure of the exposing means or an amount of the charge of the charging means according to the detecting result of the detecting means so that an examination image, which is formed by the exposing means and the developing means in the examination image forming area decided by the decision means, has a specified image quality.

11. An apparatus according to claim 6, wherein the detecting means includes an image density sensor which detects an image density of the examination image forming area.

12. An apparatus according to claim 6, wherein the detecting means includes a surface potential sensor which detects a surface potential of the examination image forming area.

13. An image forming apparatus comprising:

a photo-conductive drum being rotatable in a specified direction;

charging means for charging a surface of the photo-conductive drum;

exposing means for exposing the photo-conductive drum surface by the light from an exposure light source to form an electrostatic latent image on the photo-conductive drum;

charge eliminating means for selectively eliminating the charge on the surface of the photo-conductive drum to form an examination image forming area for an image quality change on the photo-conductive drum;

developing means for developing the electrostatic latent image to form a developer image on the examination image forming area of the photo-conductive drum;

detecting means having a specified detecting area on the photo-conductive drum for detecting a quality change of the developer image formed on the detecting area; and decision means for deciding a minimum examination image forming area which is nearly in accord with the detecting area of the detecting means by changing the examination image forming area by changing a charge eliminating area by the charge eliminating means.

14. An apparatus according to claim 13, wherein the charge eliminating means includes:

a plurality of light emission elements provided between an exposure position on the photo-conductive drum by the exposing means and the developing means in parallel along the axial direction of the photo-conductive drum; and a driving portion to change the charge eliminating area by emitting the light selectively from the light emission elements.

15. An apparatus according to claim 13, wherein the detecting area has first and second charge eliminating areas at its both ends along the axial direction of the photo-conductive drum; and the decision means makes the width of the first charge eliminating area large gradually and after deciding the width of the first charge eliminating area at the stage immediately before an examination result becomes out of a specified value, increases the width of the second charge eliminating area gradually and decides the width of the second charge eliminating area at the stage immediately before an examination result becomes out of a specified value.

16. An image forming apparatus comprising:

a photo-conductive drum being rotatable in a specified direction;

charging means for charging a surface of the photo-conductive drum;

exposing means for exposing the photo-conductive drum surface by the light from an exposure light source to form an electrostatic latent image on the photo-conductive drum;

charge eliminating means for selectively eliminating the charge on the surface of the photo-conductive drum to form an examination image forming area for an image quality change on the photo-conductive drum;

developing means for developing the electrostatic latent image to form a developer image on photo-conductive drum;

detecting means having a specified detecting area on the photo-conductive drum for detecting a surface potential of the electrostatic latent image formed on the examination image forming area of the photo-conductive drum; and decision means for deciding a minimum examination image forming area which is nearly in accord with the detecting area of the detecting means by detecting the surface potential of an examination image forming area by the detecting means and changing the size of examination image forming area by changing charge eliminating range by the charge eliminating means according to detecting result of the detecting means.

17. An examination image forming method in an image forming apparatus comprising the steps of:

exposing an image carrier to form an electrostatic latent image;

developing the electrostatic latent image with a developer to form a developer image on the image carrier;

a first detecting step to detect a quality change of an image formed in a detecting area on the image carrier;

a second detecting step to form an examination image forming area for an image quality change detecting on the image carrier by the exposing step and developing step and detects the examination image forming area;

changing the examination image forming area according to the detecting result of the second detecting step; and deciding a minimum examination image forming area that is nearly in accord with the detecting area of the second detecting step.

18. A method according to claim 17, wherein the deciding step decides the examination image forming area to a size at a stage immediately before the examination result becomes out of a specified value by reducing its size gradually according to the detecting result of the second detecting step.

19. A method according to claim 17, wherein the examination image forming area has a first edge position at one side of the detecting area and a second edge positioned at the opposite side of the first edge with the detecting area put between, the deciding step reduces the size of the examination image forming area gradually in the direction where the first edge of the examination image forming area is getting close to the detecting area and after deciding the position of the first edge at the stage immediately before the detecting result becomes out of a specified value, reduces the size of the examination image forming area gradually in the direction where the second edge of the examination image forming area is getting close to the detecting area and decides the position of the second edge at the stage immediately before the detecting result becomes out of a specified value.

20. A method according to claim 17, wherein the deciding step decides a detection starting timing in the second detecting step and an examination image forming ending position according to the detecting result of the second detecting step after forming continuous examination images in the specified direction on the surface of the image carrier by the exposing step and developing step.

* * * * *